US005877596A

United States Patent [19]

Allison

[11] Patent Number: 5,877,596

[45] **Date of Patent: *Mar. 2, 1999**

[54] UNIVERSAL ELECTRONIC BALLAST FOR A FAMILY OF FLUORESCENT LAMPS

[75] Inventor: Joseph M. Allison, Euclid, Ohio

[73] Assignee: General Electric Company, Schenectady, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 674,480

[22] Filed: Jul. 2, 1996

[51] Int. Cl.[6] ..... H05B 41/36

[52] U.S. Cl. ..... 315/308; 315/DIG. 5; 315/291

[58] Field of Search ..... 315/307, 209 R, 315/308, DIG. 5, 291

[56] References Cited

U.S. PATENT DOCUMENTS 4,958,108 9/1990 Sorgensen ..... 315/307

OTHER PUBLICATIONS (Product Note), "Ballast IC Applications Information (IR2151): Pre–Heating a Lamp Filament Without a PTC Resistor," International Rectifier Corporation, Oct. 1994, three pages.

(Product Note), "L6569: High Voltage Half Bridge Driver with Oscillator," SGS–Thompson Microelectronics, Mar. 1996, six pages.

(Product Note), "Provisional Data Sheet on IR 2155 Self–Oscillating Power MOSFET/IGBT Gate Driver," International Rectifier, Aug., 1993, five pages, the IR2155 driver being functional similar to the IR2151 driver mentioned at p. 3 of the present specification.

*Primary Examiner*—Arnold Kinkead
*Attorney, Agent, or Firm*—Charles E. Bruzga, Esq.

[57] ABSTRACT

A universal electronic ballast self-accommodates to appropriately supply power to each one of a family of different fluorescent lamps, one at a time. The ballast comprises a circuit for supplying a.c. current to a lamp in such manner that current in the lamp varies as a function of an error voltage. A summing circuit is provided together with an error amplifier for amplifying the output of the summing circuit to produce the error voltage. A circuit produces a reference voltage that is supplied to the summing circuit. A current feedback circuit feeds back to the summing circuit a first signal that varies as a function of lamp current. A voltage feedback circuit feeds back to the summing circuit at least a second signal that varies as a function of lamp voltage in such manner as to realize a ballast current-voltage characteristic that intersects respective lamp current-voltage characteristics at desired operating power for each of the family of lamps.

11 Claims, 6 Drawing Sheets

UNIVERSAL ELECTRONIC BALLAST FOR A FAMILY OF FLUORESCENT LAMPS

FIELD OF THE INVENTION

The present invention relates to a ballast, or power supply circuit, for fluorescent lamps, and, more particularly, to a ballast that self-accommodates to appropriately supply power to each one of a family of different fluorescent lamps, one at a time.

BACKGROUND OF THE INVENTION

Standard practice for designing ballasts for fluorescent lamps is to design a different ballast for lamps of different wattages. It would be desirable, however, to design a single ballast that self-accommodates to appropriately supply power to each one of a family of different fluorescent lamps, one at a time. This would simplify manufacturing and distribution of such ballasts, as well as to enable end users to select different wattage lamps for use with the same ballast.

OBJECTS AND SUMMARY OF THE INVENTION

Accordingly, it is an object of the invention to provide a ballast that self-accommodates to appropriately supply power to each one of a family of different fluorescent lamps, one at a time.

A further object of the invention is to provide a ballast of the foregoing type in which the lamps need not be modified in any way, and in which no sensors of lamp type, or user adjustments, are required.

A still further object is to provide a ballast of the noted type containing only electronic components that can be included in a low cost integrated circuit.

The foregoing objects are realized, in preferred form, by a universal electronic ballast that self-accommodates to appropriately supply power to each one of a family of different fluorescent lamps, one at a time. The ballast comprises a circuit for supplying a.c. current to a lamp in such manner that current in the lamp varies as a function of an error voltage. A summing circuit is provided together with an error amplifier for amplifying the output of the summing circuit to produce the error voltage. A circuit produces a reference voltage that is supplied to the summing circuit. A current feedback circuit feeds back to the summing circuit a first signal that varies as a function of lamp current. A voltage feedback circuit feeds back to the summing circuit at least a second signal that varies as a function of lamp voltage in such manner as to realize a ballast current-voltage characteristic that intersects respective lamp current-voltage characteristics at desired operating power for each of the family of lamps.

BRIEF DESCRIPTION OF THE DRAWINGS

The foregoing objects and further advantages and features of the invention will become apparent from the following description taken in conjunction with the drawing, in which like reference numerals refer to like parts, and in which.

DETAILED DESCRIPTION OF THE PREFERRED EMBODIMENTS

Figure 1:
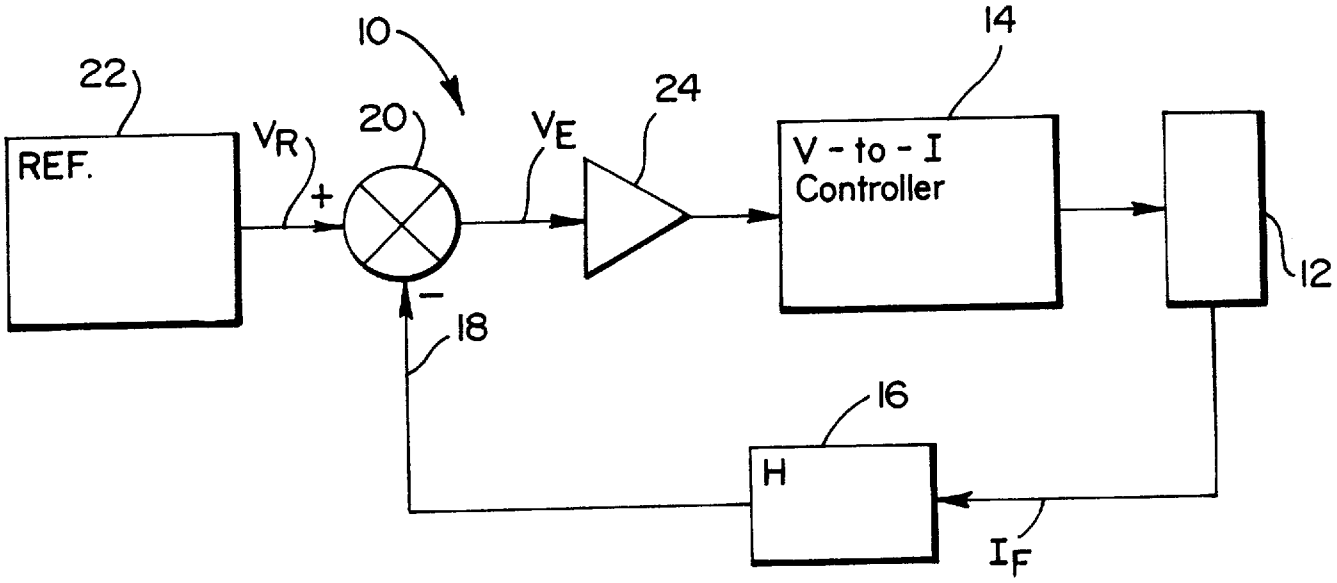
FIG. 1 PRIOR ART
FIG. 1 is a schematic diagram, partly in block form, of a prior art ballast for a fluorescent lamp, which utilizes closed-loop current feedback circuitry to maintain a stable lamp current.

FIG. 1 shows a prior art ballast, or power supply, circuit 10 for a fluorescent lamp 12. Ballast 10 includes a voltage-to-current (V-to-I) controller 14 for controlling the level of current fed to the lamp. A feedback current $I_F$ representing (i.e., being proportional to) lamp current is scaled in circuit 16, and the scaled output applied as a negative input to a summing circuit 20. A reference voltage circuit 22 supplies a positive input to summing circuit 20. The output of summing circuit 20 is an error voltage $V_E$ that is scaled in an error amplifier 24, whose scaled output is applied to voltage-to-current controller 14. In operation, as lamp current increases, feedback current $I_F$ increases, causing a larger negative input to summing circuit 20. The output of summing circuit 20 then decreases, causing voltage-to-current controller 14 to reduce the current supplied to the lamp. The converse it true, that is, a decrease in lamp current results in an error voltage $V_E$ that causes lamp current to increase. In this manner, the lamp current is kept stable at a value determined by reference voltage $V_R$.

Figure 2:
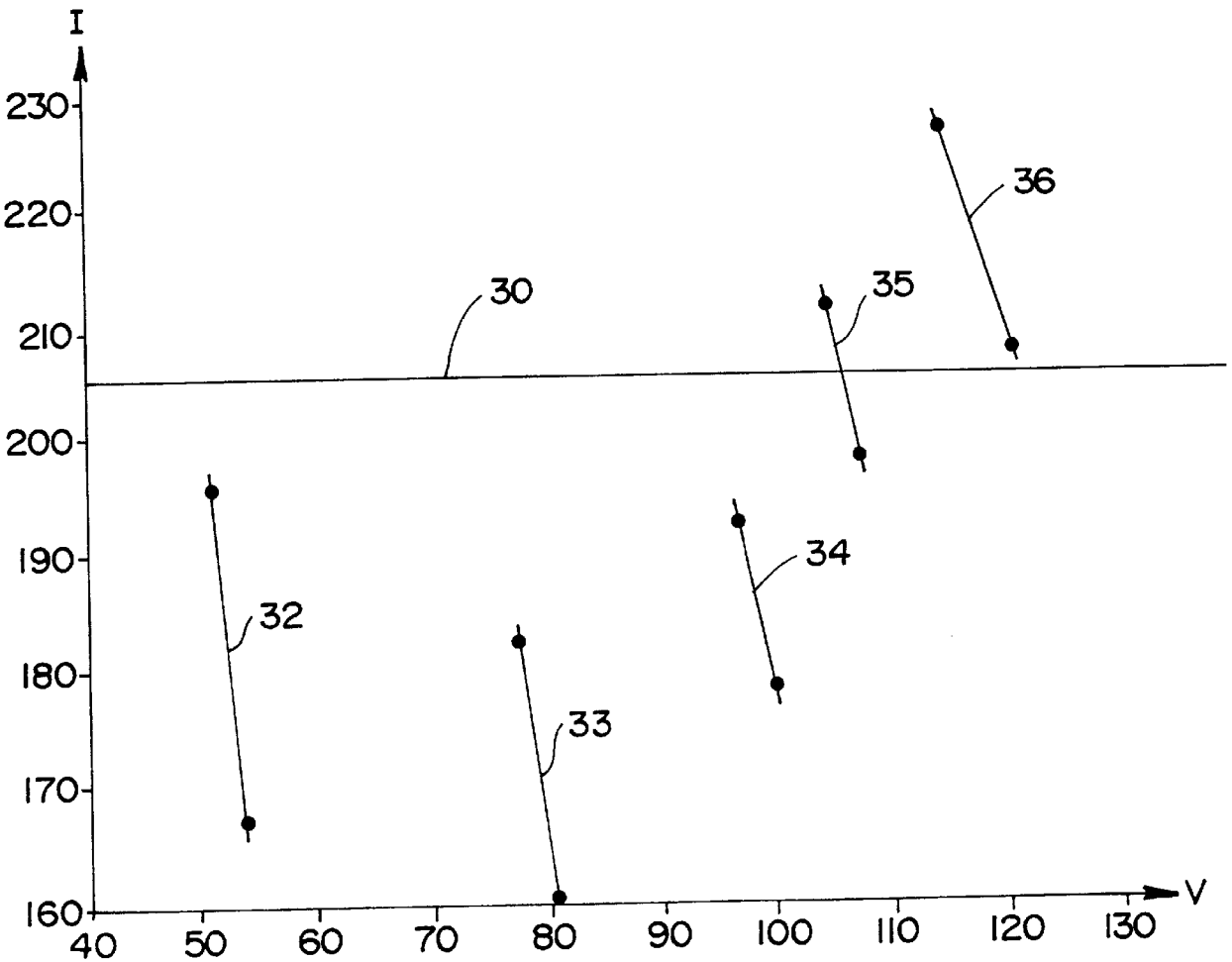
FIG. 2 PRIOR ART
FIG. 2 shows the current-voltage characteristic for the prior art ballast of FIG. 1, together with current-voltage characteristics for a typical family of fluorescent lamps.

As described, ballast 10 utilizes the well-known principle of closed-loop feedback circuitry to stabilize an output parameter, here the lamp current. The resultant current-voltage (I—V) characteristic of ballast 10 is shown as a straight line characteristic 30 in FIG. 2, as expected, with current and voltage values in root mean square (r.m.s.) amps and volts, respectively. Also shown in FIG. 2 are desirable operating portions of I—V characteristics 32, 33, 34, 35 and 36 of a typical family of fluorescent lamps, which respectively are rated in wattage at 11, 15, 20, 23 and 28 watts. A desirable operating portion of a lamp I—V characteristic is that portion in which lamp power is suitable. For example, the portion of lamp I—V characteristic 35, nominally for a 23 watt lamp, varies between 19:2 watts at the lower (unnumbered) dot on the characteristic and 20 watts at the upper (unnumbered) dot. Corresponding upper and lower dots for lamp I—V characteristics 32, 33, 34 and 36 respectively vary between 10 and 9 watts, 13.4 and 12.4 watts, 17.4 and 16.7 watts, and 23.8 and 25 watts. As is graphically depicted in FIG. 2, the ballast I—V characteristic 30 properly intersects only one lamp I—V characteristic, i.e., characteristic 35. Naturally, then, ballast 10 is suitable only for the lamp having I—V characteristic 35.

Figure 3:
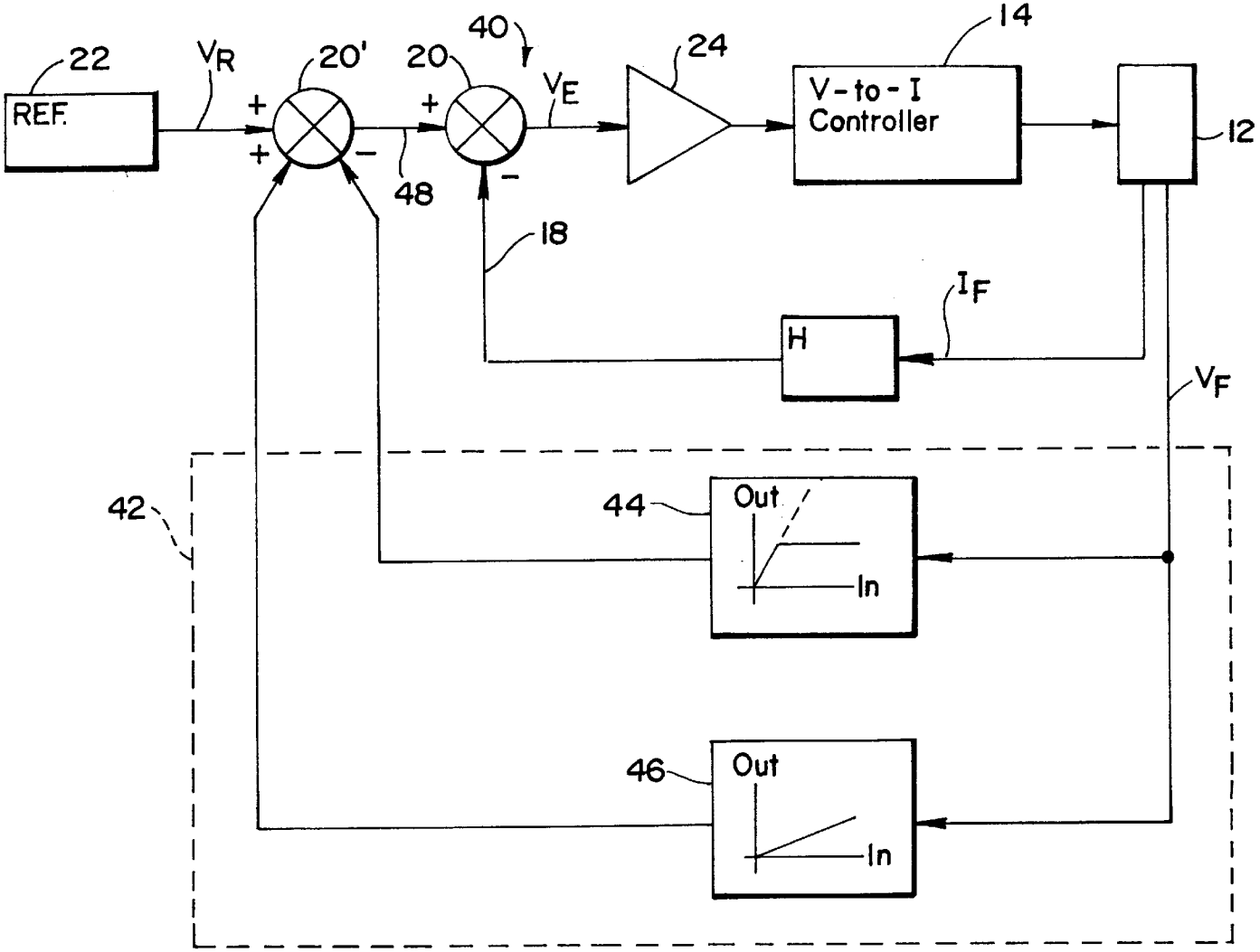
FIG. 3 is a schematic diagram, partly in block form, of a ballast for a fluorescent lamp utilizing principles of the present invention to make the ballast suitable for each of a family of fluorescent lamps.

In contrast, an object of the present invention is to provide a universal ballast that is suitable for each of a family of fluorescent lamps, such as those having I—V characteristics 32, 33 34, 35 and 36 in FIG. 2. In order to realize this inventive object, ballast 40 of FIG. 3 is provided. The major difference between inventive ballast 40 and prior art ballast 10 (FIG. 1) is that ballast 40 additionally incorporates feedback circuitry 42, which is responsive to feedback voltage $V_F$ representing lamp voltage. Feedback circuits 44 and 46 of circuitry 42 condition feedback voltage $V_F$ in such manner that, when their outputs are applied to summing circuit 20, 20' in the illustrated polarities, an I—V characteristic for ballast 40 is produced which intersects desirable operating portions of I—V characteristics for a family of lamps.

Figure 4:
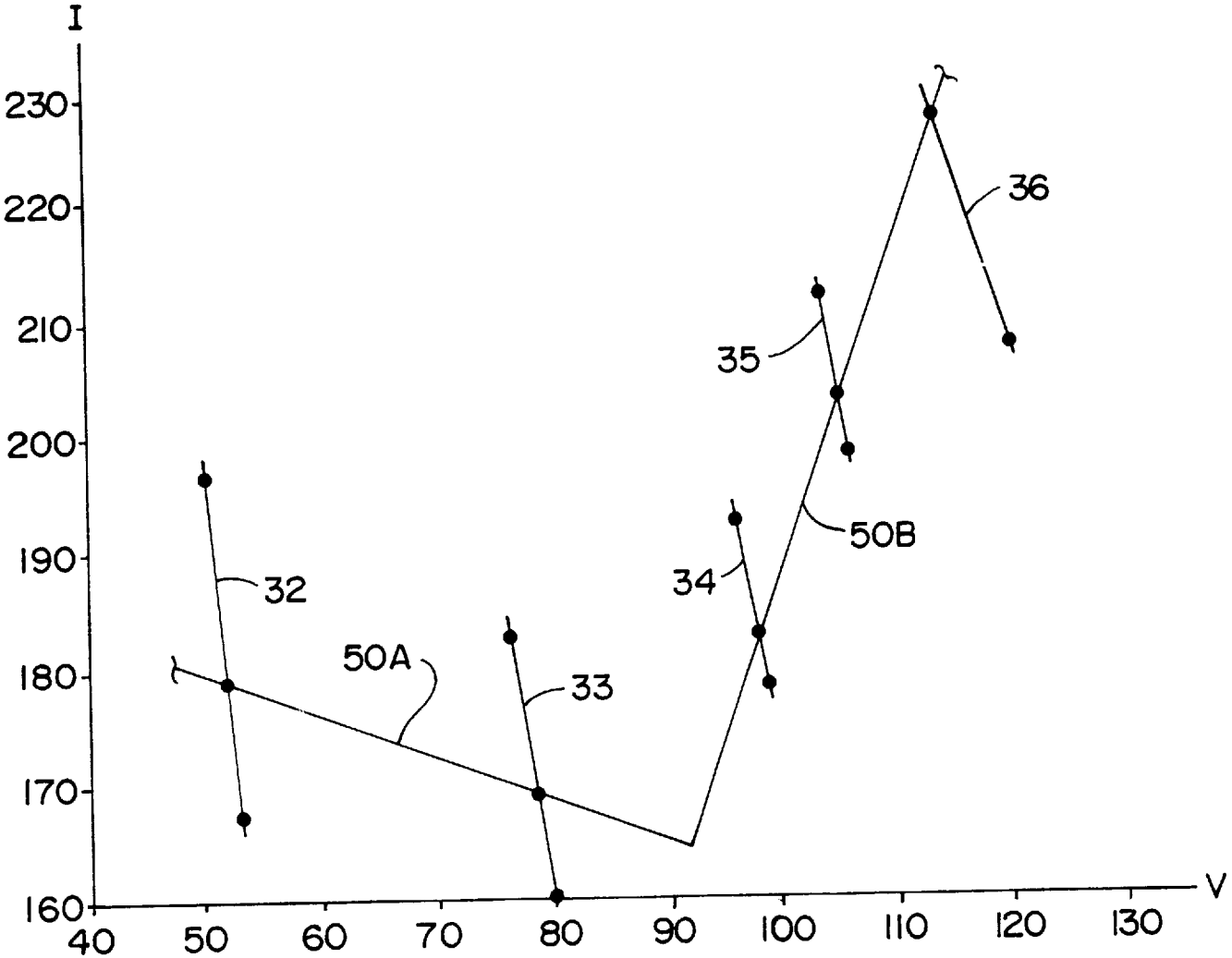
FIG. 4 is similar to FIG. 2 except that it shows the current-voltage characteristic for the inventive ballast of FIG. 3, together with current-voltage characteristics for a typical family of fluorescent lamps.

Referring to FIG. 4, I—V characteristic 50A, 50B is shown for inventive ballast 40 of FIG. 3, and comprises linear section 50A having one slope, and a linear section 50B having another slope. Also shown are the I—V characteristics 32, 33, 34, 35 and 36 for the previously mentioned family of lamps. Apart from the different ballast characteristics between FIGS. 2 and 4, i.e., FIG. 2 showing prior art characteristic 30 and FIG. 4 showing inventive characteristic 50A, 50B, the other details of FIGS. 2 and 4 are the same. Ballast I—V characteristic 50A, 50B, in contrast to prior art ballast I—V characteristic 30 of FIG. 2, intersects desirable operating portions of the I—V characteristics 32, 33, 34, 35 and 35 for the entire family of lamps, and, in particular, intersects those characteristics at the desired wattages of 9.4, 12.8, 17.1, 19.6 and 23.8. This results in a universal ballast 40 that self-accommodates to appropriately supply power to each one of a family of different fluorescent lamps, one at a time.

As can be seen from FIG. 4, ballast characteristic 50A, 50B intersects lamp characteristics 32, 33, 34, 35 and 36 at only one point of those characteristics. If, in contrast, the ballast characteristic intersected a lamp characteristic at more than one point, instability of lamp operation would occur.

Now, considering again inventive ballast 40 of FIG. 3, the creation of ballast characteristic 50A, 50B of FIG. 4 will now be explained. Feedback circuit 44, which may be an amplifier (not shown) with a voltage limiter such as a Zener diode, amplifies feedback voltage $V_F$ up to some voltage limit at which circuit 44 outputs a constant voltage. Such operation is illustrated in the block for circuit 44. The output of circuit 44 is applied with negative polarity to summing circuit 20, 20'.

Summing circuit 20' is shown as separate from summing circuit 20, for convenience, so that output 48 of circuit 20' may be more easily compared to the output of reference voltage circuit 22 of FIG. 1. That is, output 48 may be likened to a fluctuating reference voltage, rather than to a fixed reference voltage as would be the typical output of circuit 22 of FIG. 1. However, it will be obvious to a person of ordinary skill in the art that summing circuits 20 and 20' may equally well be shown as a single summing circuit.

Meanwhile, feedback circuit 46 amplifies feedback voltage $V_F$ with less gain than feedback circuit 44, as can be appreciated from the output-versus-input transfer function in the block for circuit 46, which has a less-inclined slope than the transfer function in the block for circuit 44. With the output of circuit 46 being applied as a positive input to summing circuit 20', and the output of circuit 44 being applied as a negative input to such summing circuit, ballast characteristic 50A of FIG. 4 is realized with a negative slope. As feedback voltage $V_F$ increases and reaches the "knee" at the upper voltage limit shown in the transfer function in the block for circuit 44, such circuit outputs a constant level of voltage as feedback voltage $V_F$ continues to increase. With circuit 46 outputting an increasingly higher level of voltage, ballast characteristic 50B of FIG. 4 is realized with a positive slope.

Figure 5:
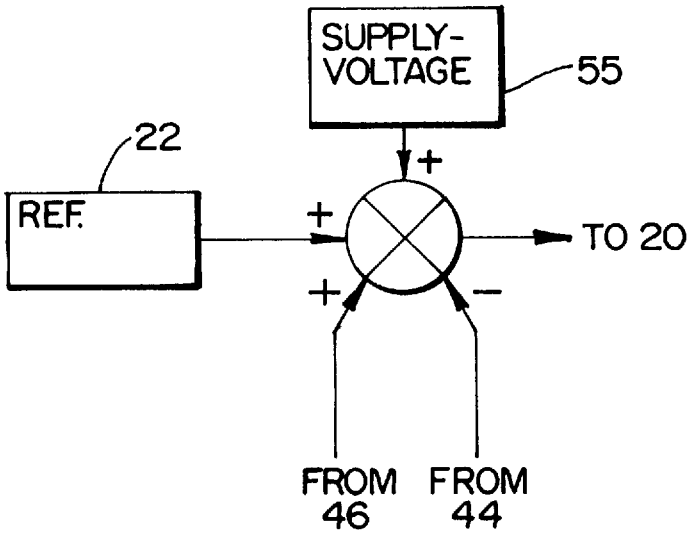
FIG. 5 is a detail, schematic diagram, showing a modification to the ballast of FIG. 3.

Additional control inputs could be applied to summing circuit 20, 20' of inventive ballast 40 of FIG. 3. For instance, as shown in the detail, schematic diagram of FIG. 5, showing a modification to ballast 40 of FIG. 3, a circuit 55 may be provided to apply to summing circuit 20' a signal that varies with the supply voltage, which is typically the voltage of a.c. power mains. In this manner, as the supply voltage drops to a brown-out condition, for instance, error voltage $V_E$ first goes negative, causing a reduction in the operating current of lamp 12, and stabilizes when the lamp current reaches a lower level. Conversely, as the supply voltage increases, circuit 55 increases the voltage applied to summing circuit 20', which, in turn, causes error voltage $V_E$ to initially become positive so as to raise the lamp operating current until a new, higher current level is reached. The foregoing circuit 55 can be considered a feed-forward control aspect of ballast 40.

Figure 6:
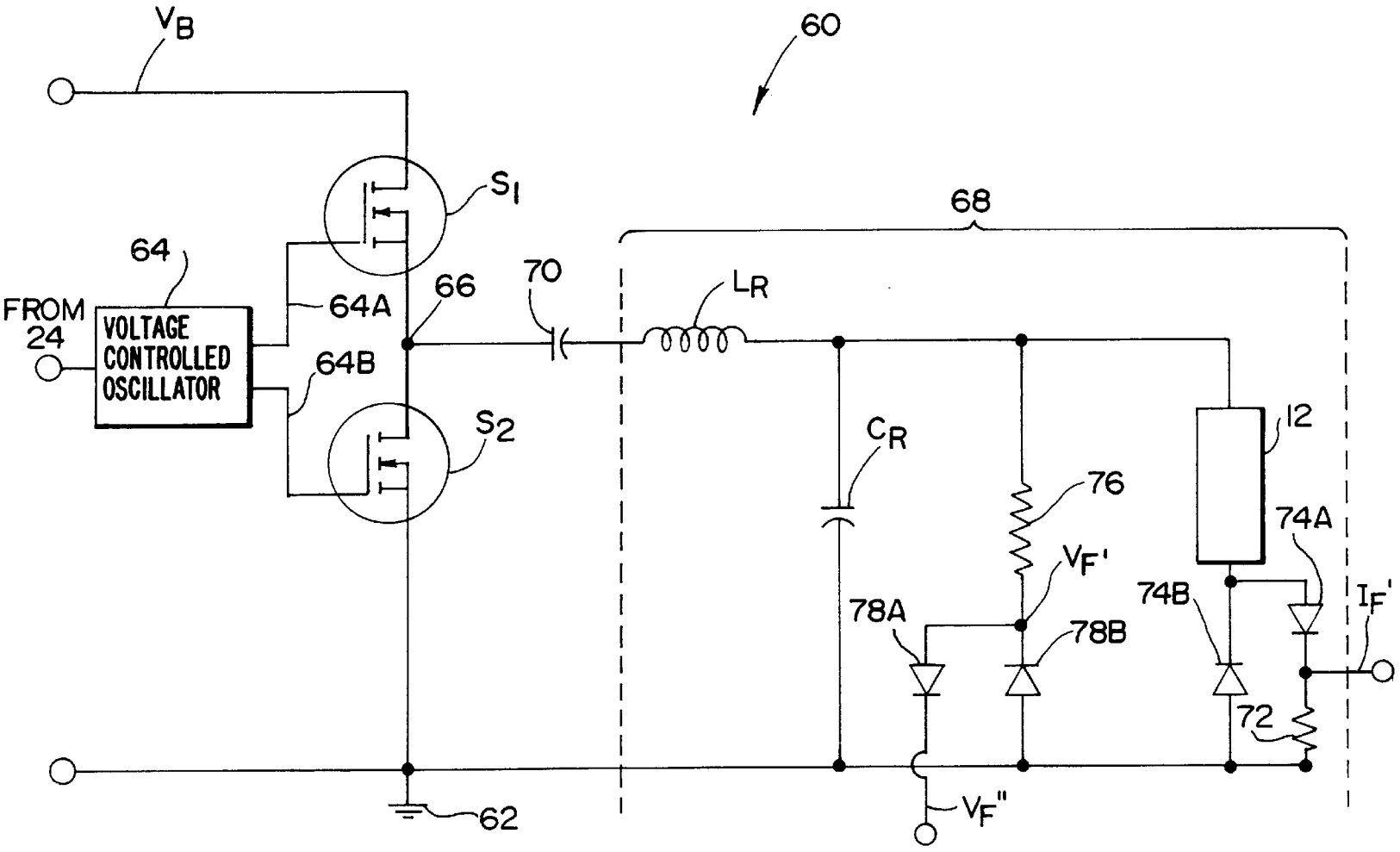
FIG. 6 shows a preferred circuit in schematic form and partially in block for implementing the voltage-to-current controller of the inventive ballast of FIG. 3.

Many ways of implementing the voltage-to-current controller 14 of inventive ballast 40 of FIG. 3 will occur to those of ordinary skill in the art. For instance, the output of error amplifier 24 could control the output voltage of a d.c.-to-d.c. converter (not shown), which is then passed to a lamp, though an d.c.-to-a.c. converter. One preferred circuit for implementing the voltage-to-current controller 14 is shown as circuit 60 in FIG. 6. In FIG. 6, a d.c. bus voltage $V_B$, with respect to a ground 62, is impressed across the series combination of switches $S_1$ and $S_2$, which are preferably MOSFETs. A voltage-controlled oscillator (VCO) 64 is responsive to the output of error amplifier 24 of FIG. 3, and provides gate control signals on its output lines 64A and 64B to control the on states of switches $S_1$ and $S_2$. In particular, VCO 64 causes switches $S_1$ and $S_2$ to alternatively be turned on (or conducting) at a frequency that varies as a function of the voltage supplied by error amplifier 24 (FIG. 3). VCO 64 also provides a suitable dead time between the times of either switch conducting so as to reduce switching losses in a well known manner. Such a feature may provided, for instance, by an IR2151 integrated circuit, designated a "Self-Oscillating Half-Bridge Driver," and which is sold by International Rectifier Company of El Segundo, Calif.

The intermediate node 66 between switches $S_1$ and $S_2$ is alternately connected between bus voltage $V_B$ and ground 62 by virtue of the described switching action of the switches. A bidirectional, or a.c., current is therefore caused to flow in a resonant load circuit 68 comprising lamp 12, resonant capacitor $C_R$, which shunts the lamp, and resonant inductor $L_R$ through which current is fed to the parallel combination of the lamp and resonant capacitor. A d.c. blocking capacitor 70 prevents d.c. current from flowing in resonant load circuit 68. Meanwhile, a current feedback signal $I_F'$ is derived as the voltage across a resistor 72, which is connected to the lamp by a half-wave rectifier comprising diodes 74A and 74B. Current feedback signal $I_F'$ is then passed through a low pass filter (not shown) to provide feedback current $I_F$ of FIG. 3, which is a d.c. signal approximately proportional to the lamp current. Meanwhile, voltage feedback signal $V_F'$ is provided on the lower-shown node of resistor 76 (with respect to ground 62); voltage feedback signal $V_F''$ is approximately the same as signal $V_F$, although differing by the voltage drop across diode 78A. Diodes 78A and 78B comprise a half-wave rectifier in similar manner as diodes 74A and 74B. Voltage feedback signal $V_F''$ is then passed through a low pass filter (not shown) to provide feedback voltage $V_F$ of FIG. 3, which is a d.c. voltage approximately proportional to lamp voltage.

Figure 7:
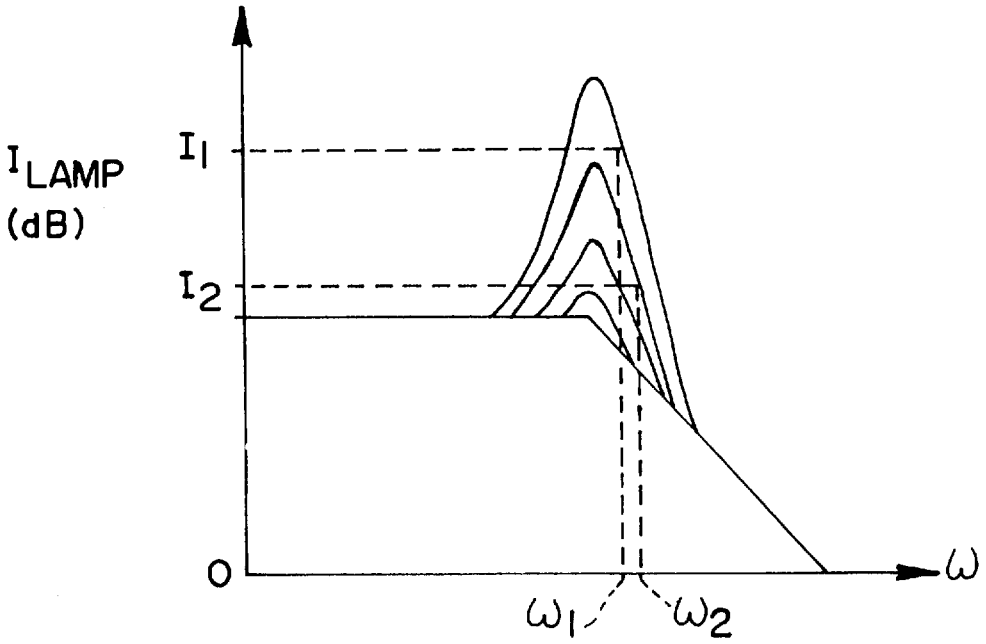
FIG. 7 is a simplified lamp current-versus-angular frequency graph illustrating the change in lamp current resulting from a change in operating frequency of the lamp.

The frequency of a.c. current supplied to resonant load circuit 68 determines the level of such a.c. current. This principle is illustrated in FIG. 7, which shows a lamp current-versus-angular frequency graph for lamp 12 contained in such resonant load circuit. At an angular frequency $\omega_1$, the lamp current is at level $I_1$. By changing the angular frequency of lamp current to $\omega_2$, the lamp current drops to level $I_2$. Therefore, adjustment of the frequency of switching of switches $S_1$ and $S_2$ (FIG. 3) determines the level of current in the lamp.

While the invention has been described with respect to specific embodiments by way of illustration, many modifications and changes will occur to those skilled in the art. It is therefore, to be understood that the appended claims are intended to cover all such modifications and changes as fall within the true spirit and scope of the invention.

What is claimed is:

1. A universal electronic ballast that respectively supplies power to each one of a family of different fluorescent lamps, said ballast comprising:

(a) a circuit for supplying a.c. current to a lamp in such manner that current in said lamp varies as a function of an error voltage;

(b) a summing circuit and an error amplifier for amplifying the output of said summing circuit to produce said error voltage;

(c) a circuit for producing a reference voltage that is supplied to said summing circuit;

(d) a current feedback circuit for feeding back to said summing circuit a first signal that varies as a function of lamp current; and (e) a voltage feedback circuit for feeding back to said summing circuit at least a second signal that varies as a function of lamp voltage in such manner as to realize a ballast current-voltage characteristic which intersects respective lamp current-voltage characteristics at desired operating power for each of said family of lamps and which comprises a non-constant current characteristic;

(f) whereby said ballast self-accommodates to appropriately supply power to each one of said family of fluorescent lamps, one at a time.

2. The ballast of claim 1, wherein said ballast current-voltage characteristic comprises at least one linear segment.

3. The ballast of claim 1, wherein said voltage feedback circuit feeds back to said summing circuit at least second and third signals that respectively vary as a function of lamp voltage so as to result in a ballast current-voltage characteristic comprising at least two linear segments that are angled with respect to each other.

4. The ballast of claim 3, wherein said voltage feedback circuit includes means to make one of said at least second and third signals vary in proportion to said lamp voltage over a range of operation of said lamp but that stays at a constant value as said lamp voltage continues to increase above a boundary level.

5. The ballast of claim 1, further comprising a circuit for producing a signal which varies with the voltage of power mains supplying said ballast and which is applied to said summing circuit.

6. A universal electronic ballast that respectively supplies power to each one of a family of different fluorescent lamps, said ballast comprising:

(a) a circuit for supplying a.c. current to said lamp in such manner that current in said lamp varies with the frequency of said a.c. current; said frequency, in turn, varying as a function of an error voltage;

(b) a summing circuit and an error amplifier for amplifying the output of said summing circuit to produce said error voltage;

(c) a circuit for producing a reference voltage that is supplied to said summing circuit;

(d) a current feedback circuit for feeding back to said summing circuit a first signal that varies as a function of lamp current; and (e) a voltage feedback circuit for feeding back to said summing circuit at least a second signal that varies as a function of lamp voltage in such manner as to realize a ballast current-voltage characteristic which intersects respective lamp current-voltage characteristics at desired operating power for each of said family of lamps and which comprises a non-constant current characteristic;

(f) whereby said ballast self-accommodates to appropriately supply power to each one of said family of fluorescent lamps, one at a time.

7. The ballast of claim 6, wherein said circuit for supplying a.c. current to said lamp comprises a resonant inductor and a resonant capacitor.

8. The ballast of claim 6, wherein said ballast current-voltage characteristic comprises at least one linear segment.

9. The ballast of claim 6, wherein said voltage feedback circuit feeds back to said summing circuit at least second and third signals that respectively vary as a function of lamp voltage so as to result in a ballast current-voltage characteristic comprising at least two linear segments that are angled with respect to each other.

10. The ballast of claim 9, wherein said voltage feedback circuit includes means to make one of said at least second and third signals vary in proportion to said lamp voltage over a range of operation of said lamp but that stays at a constant value as said lamp voltage continues to increase above a boundary level.

11. The ballast of claim 6, further comprising a circuit for producing a signal which varies with the voltage of power mains supplying said ballast and which is applied to said summing circuit.

* * * * *